US007494252B1

(12) United States Patent
Thornton et al.

(10) Patent No.: US 7,494,252 B1
(45) Date of Patent: Feb. 24, 2009

(54) COMPACT LUMINAIRE ENCLOSURE

(75) Inventors: Gerry F. Thornton, Littlestown, PA (US); Matthew S. Pressel, Dover, PA (US); James Hickman, New Oxford, PA (US); Jesse Wojtkowiak, Littlestown, PA (US); Gary E. Kehr, Abbotstown, PA (US); Richard A. Groft, New Oxford, PA (US); William H. Doron, Jr., Hanover, PA (US); Kimberly A. Renner, Hanover, PA (US); Justin M. Walker, York, PA (US); Brian Breckenridge, Mechanicsburg, PA (US); Lew Waltz, Hanover, PA (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 11/736,163

(22) Filed: Apr. 17, 2007

Related U.S. Application Data

(60) Provisional application No. 60/806,248, filed on Jun. 29, 2006.

(51) Int. Cl.
*F21V 29/00* (2006.01)

(52) U.S. Cl. ..... 362/294; 362/659; 362/657; 362/658; 362/652; 362/362; 362/373; 362/154; 362/21; 362/648; 362/647

(58) Field of Classification Search ..... None
See application file for complete search history.

(56) References Cited

U.S. PATENT DOCUMENTS

| | | | |
|---|---|---|---|
| 463,337 | A | 11/1891 | Porteous |
| 1,045,852 | A | 12/1912 | Jones |
| 1,204,801 | A | 11/1916 | McArthur |
| 1,246,728 | A | 11/1917 | Downey |
| 1,247,000 | A | 11/1917 | Plaut |
| D51,774 | S | 2/1918 | Coppinger |
| 1,357,539 | A | 11/1920 | Bissell |
| 1,639,753 | A | 8/1927 | Shelton |
| 1,701,176 | A | 2/1929 | Doane |
| 1,702,746 | A | 2/1929 | Prichard |
| 1,900,436 | A | 3/1933 | Dourgnon |
| 1,902,587 | A | 3/1933 | Sawin |
| 1,941,503 | A | 1/1934 | Villiers |
| 1,969,714 | A | 8/1934 | Burger |
| 2,080,120 | A | 5/1937 | Everett |

(Continued)

*Primary Examiner*—Ismael Negron
*Assistant Examiner*—Danielle Dunn
(74) *Attorney, Agent, or Firm*—James E. Cole; Middleton Reutlinger

(57) ABSTRACT

The invention generally comprises a compact luminaire enclosure that preferably contains about 14 to 18 cubic inches of air volume and can be used safely with a 50 watt luminaire. The luminaire enclosure comprises a housing and a shroud that is removably attached to the housing. The shroud has a non-planar face that prevents the shroud from laying flat and trapping heat if the enclosure is placed on or falls on a flat surface. The housing can comprise polyetherimide, which has very good heat dissipation properties. The shroud may also comprise polyetherimide. The compact luminaire enclosure of the invention further comprises an internal thermal lamp shield recessed within the housing. The internal thermal lamp shield comprises highly specular material so that it is able to reflect much of the heat coming from an enclosed luminaire. In one embodiment of the invention, the luminaire comprises anodized aluminum.

21 Claims, 8 Drawing Sheets

U.S. PATENT DOCUMENTS

| | | | | |
|---|---|---|---|---|
| 2,198,077 | A | | 4/1940 | Curtis |
| 2,438,908 | A | | 4/1948 | Goodall |
| 2,480,178 | A | | 8/1949 | Zinberg |
| 2,758,199 | A | | 8/1956 | Yonkers |
| 2,836,709 | A | | 5/1958 | Van Dusen, Jr. |
| 2,960,361 | A | | 11/1960 | Boutelle |
| 3,040,994 | A | | 6/1962 | Anderson et al. |
| 3,055,635 | A | | 9/1962 | Schneider |
| 3,096,029 | A | | 7/1963 | Berge |
| 3,202,070 | A | | 8/1965 | Pratt, Jr. et al. |
| 3,270,192 | A | | 8/1966 | Watson |
| 3,299,265 | A | | 1/1967 | Rackley et al. |
| 3,299,591 | A | | 1/1967 | Woelk |
| 3,347,008 | A | | 10/1967 | Strengholt |
| 3,413,462 | A | | 11/1968 | Spero |
| 3,461,283 | A | | 8/1969 | Hahn |
| 3,474,206 | A | * | 10/1969 | Gryctko ..... 200/293 |
| 3,529,148 | A | | 9/1970 | Stefano et al. |
| 3,543,016 | A | | 11/1970 | Jones |
| 3,560,728 | A | | 2/1971 | Atkin |
| 3,679,889 | A | | 7/1972 | Franck |
| 3,701,898 | A | | 10/1972 | McNamara, Jr. |
| 3,711,702 | A | | 1/1973 | Adra |
| 3,748,465 | A | | 7/1973 | Murray et al. |
| 3,790,774 | A | | 2/1974 | Miller et al. |
| 3,940,898 | A | | 3/1976 | Kaufman |
| 3,990,201 | A | | 11/1976 | Falbel |
| 3,991,905 | A | | 11/1976 | Nicpon |
| 4,001,778 | A | | 1/1977 | Ross |
| 4,015,394 | A | | 4/1977 | Kessler |
| 4,027,151 | A | | 5/1977 | Barthel |
| 4,029,630 | A | | 6/1977 | Meinhold et al. |
| 4,090,210 | A | | 5/1978 | Wehling et al. |
| 4,091,444 | A | | 5/1978 | Mori |
| 4,118,767 | A | | 10/1978 | Urbanek |
| 4,141,061 | A | | 2/1979 | Ford et al. |
| 4,143,412 | A | | 3/1979 | Sassmannshausen |
| 4,143,413 | A | | 3/1979 | Kelly |
| 4,155,111 | A | | 5/1979 | Kelly et al. |
| 4,164,010 | A | | 8/1979 | Finch |
| 4,164,784 | A | | 8/1979 | Jaksich |
| 4,173,037 | A | | 10/1979 | Henderson, Jr. et al. |
| 4,188,657 | A | | 2/1980 | Reibling |
| 4,213,170 | A | | 7/1980 | Kimball et al. |
| 4,218,727 | A | | 8/1980 | Shemitz et al. |
| 4,229,782 | A | | 10/1980 | Ruud et al. |
| 4,240,853 | A | | 12/1980 | Pustka |
| 4,242,725 | A | | 12/1980 | Douma et al. |
| 4,261,028 | A | | 4/1981 | Adam |
| 4,261,030 | A | | 4/1981 | Hernandez |
| 4,293,901 | A | | 10/1981 | Hernandez |
| 4,310,875 | A | * | 1/1982 | Price ..... 362/277 |
| 4,310,876 | A | | 1/1982 | Small, Jr. et al. |
| 4,318,237 | A | | 3/1982 | Hicks |
| 4,323,954 | A | | 4/1982 | Florence et al. |
| 4,323,956 | A | | 4/1982 | Pustka |
| 4,360,863 | A | | 11/1982 | Barnes et al. |
| 4,364,108 | A | | 12/1982 | Rapp |
| 4,390,934 | A | | 6/1983 | Willing |
| 4,395,750 | A | | 7/1983 | Scheidemann et al. |
| 4,410,931 | A | | 10/1983 | DeCandia et al. |
| 4,447,863 | A | | 5/1984 | Fenne |
| 4,450,660 | A | | 5/1984 | Dean et al. |
| 4,451,875 | A | | 5/1984 | Odie et al. |
| 4,459,789 | A | | 7/1984 | Ford |
| 4,471,411 | A | | 9/1984 | Graham et al. |
| 4,480,809 | A | | 11/1984 | Healey |
| 4,516,196 | A | | 5/1985 | Blake |
| 4,527,224 | A | | 7/1985 | Sangiamo et al. |
| 4,531,180 | A | | 7/1985 | Hernandez |
| 4,546,420 | A | | 10/1985 | Wheeler et al. |
| 4,559,587 | A | | 12/1985 | Quiogue et al. |
| 4,564,888 | A | | 1/1986 | Lewin et al. |
| 4,569,003 | A | | 2/1986 | Elmer et al. |
| 4,587,602 | A | | 5/1986 | Dean et al. |
| 4,602,320 | A | | 7/1986 | Tomkin et al. |
| 4,626,975 | A | | 12/1986 | Miletich |
| 4,717,991 | A | | 1/1988 | Murphree, Jr. |
| 4,731,714 | A | | 3/1988 | Kelly et al. |
| 4,766,709 | A | | 8/1988 | Galbraith |
| 4,786,344 | A | | 11/1988 | Beuther |
| 4,816,969 | A | | 3/1989 | Miller |
| 4,851,970 | A | | 7/1989 | Bronder |
| 4,858,091 | A | | 8/1989 | Fouke |
| 4,862,333 | A | | 8/1989 | Brasket |
| 4,881,156 | A | | 11/1989 | Shemitz et al. |
| 4,893,224 | A | | 1/1990 | Tinley |
| 4,894,758 | A | | 1/1990 | O'Toole |
| 4,937,718 | A | | 6/1990 | Murray |
| 5,016,150 | A | | 5/1991 | Gordin et al. |
| 5,050,055 | A | | 9/1991 | Lindsay et al. |
| 5,051,878 | A | | 9/1991 | Ngai |
| 5,062,029 | A | | 10/1991 | Engel |
| 5,081,569 | A | | 1/1992 | Quiogue et al. |
| 5,099,405 | A | | 3/1992 | Gehly et al. |
| 5,111,371 | A | | 5/1992 | Nielson |
| 5,140,507 | A | | 8/1992 | Harwood |
| 5,158,348 | A | | 10/1992 | Sakamoto et al. |
| 5,183,331 | A | | 2/1993 | Edgell et al. |
| 5,211,473 | A | | 5/1993 | Gordin et al. |
| 5,278,737 | A | | 1/1994 | Luce et al. |
| 5,278,745 | A | | 1/1994 | Kelly et al. |
| 5,289,358 | A | | 2/1994 | Halemeier |
| 5,307,254 | A | | 4/1994 | Russello et al. |
| 5,313,379 | A | | 5/1994 | Lemons et al. |
| D348,745 | S | | 7/1994 | Ewing et al. |
| 5,363,293 | A | | 11/1994 | Lasker |
| 5,377,087 | A | | 12/1994 | Yoon |
| 5,379,199 | A | | 1/1995 | Hirshenhorn et al. |
| 5,383,102 | A | | 1/1995 | Jones |
| 5,404,297 | A | | 4/1995 | Birk et al. |
| 5,435,087 | A | | 7/1995 | Karkar et al. |
| 5,446,637 | A | | 8/1995 | Cunningham et al. |
| 5,450,303 | A | | 9/1995 | Markiewicz et al. |
| D364,242 | S | | 11/1995 | Fiorato |
| D370,228 | S | | 5/1996 | Chapman et al. |
| 5,546,292 | A | | 8/1996 | Shemitz |
| 5,572,819 | A | | 11/1996 | Topinka et al. |
| 5,584,574 | A | * | 12/1996 | Haddad ..... 362/359 |
| 5,586,015 | A | | 12/1996 | Baldwin et al. |
| 5,599,091 | A | * | 2/1997 | Kira ..... 362/269 |
| 5,613,766 | A | | 3/1997 | Rauof |
| 5,615,947 | A | | 4/1997 | Shambo et al. |
| 5,642,934 | A | | 7/1997 | Haddad |
| 5,651,606 | A | | 7/1997 | Krogman |
| 5,704,710 | A | | 1/1998 | Greene et al. |
| 5,707,142 | A | | 1/1998 | Gordin |
| D390,994 | S | | 2/1998 | Ewing et al. |
| D390,995 | S | | 2/1998 | Ewing et al. |
| D391,383 | S | | 2/1998 | Ewing et al. |
| 5,713,662 | A | | 2/1998 | Kira |
| 5,722,770 | A | | 3/1998 | Douglas |
| 5,743,632 | A | | 4/1998 | Carl |
| D400,277 | S | | 10/1998 | Ewing et al. |
| 5,826,975 | A | | 10/1998 | Hsieh et al. |
| 5,909,955 | A | * | 6/1999 | Roorda ..... 362/368 |
| 5,938,317 | A | * | 8/1999 | Thornton ..... 362/290 |
| 5,988,833 | A | * | 11/1999 | Giese et al. ..... 362/287 |
| 5,997,156 | A | | 12/1999 | Perlo et al. |
| 5,997,158 | A | | 12/1999 | Fischer et al. |
| 6,017,131 | A | | 1/2000 | Goins |
| 6,027,231 | A | | 2/2000 | Fouke |
| D424,736 | S | | 5/2000 | Johnson |
| 6,059,422 | A | | 5/2000 | Fischer et al. |

6,123,438 A 9/2000 Hentz
6,234,643 B1 5/2001 Lichon, Jr.
6,238,065 B1 5/2001 Jones
6,260,981 B1 7/2001 Fiene
6,375,338 B1 4/2002 Cummings et al.
6,402,352 B1 6/2002 Summerford et al.
6,450,657 B1 9/2002 Testa et al.
D469,565 S 1/2003 Anderson et al.
6,523,982 B1 2/2003 Haddad
6,703,799 B2 3/2004 Summerford et al.
6,808,292 B2 10/2004 Wong
6,840,658 B2 1/2005 Anderson et al.
6,945,675 B2 9/2005 Jongewaard et al.
6,981,783 B2 * 1/2006 Kao ..... 362/285
7,059,747 B2 6/2006 Barozzini et al.
7,121,684 B2 10/2006 Barozzini et al.
2004/0120148 A1 6/2004 Morris et al.
2004/0264197 A1 12/2004 Bewig et al.
2005/0117333 A1 6/2005 Yoshida et al.
2005/0281034 A1 12/2005 Summerford et al.

* cited by examiner

COMPACT LUMINAIRE ENCLOSURE

CROSS-REFERENCE TO RELATED APPLICATIONS

This application under 35 U.S.C. § 119(*e*), claims priority to and benefit from U.S. Provisional Application No. 60/806,248, which was filed on Jun. 29, 2006, entitled, "Compact Luminaire Enclosure," which is currently pending, naming all the individuals listed above as inventors, the entire disclosure of which is contained herein by reference.

BACKGROUND OF THE INVENTION

1. Field of the Invention

The present invention relates to a compact luminaire enclosure. More particularly, the present invention relates to a compact luminaire enclosure designed to dissipate heat such that it can be used safely with a 50 watt lamp.

2. Background of the Invention

Manufacturers are continually struggling with external luminaire enclosure temperatures that exceed the recommended maximum safety practices. Since luminaires give off a good deal of heat, which rises, typically the affected surfaces are the internal and external luminaire enclosure surfaces above the light source. This problem can be exacerbated if the luminaire enclosure opening should become covered.

Luminaire enclosures can be made from a variety of materials, but they are often made of plastic. A luminaire enclosure constructed from plastic generally requires a large volume of air to effectively manage heat emanating from the lamp & electronics. When a plastic enclosure experiences the cyclic heating and cooling conditions that result from periodic use of the luminaire, the chemical bonds within the molecules of plastic begin to weaken or break. Once these bonds begin to break, the breaking process accelerates at an exponential rate, thereby degrading the physical and mechanical properties of the plastic enclosure very quickly.

When the structure of the enclosure weakens and breaks down, the enclosure can no longer effectively dissipate heat. The heat produced by the luminaire becomes more and more concentrated within the enclosure over time, which causes the luminaire to exceed its maximum operating temperature. Eventually, this leads to the premature failure of the electronic components of the luminaire or the enclosure itself, or perhaps both.

In addition to the mechanical failure described above, the poor thermal management qualities of plastic luminaire enclosures and excessive internal and external enclosure surface temperatures can result in the failure to obtain third party safety agency listings and approvals. Non-acceptance of local government agencies, national government agencies, and other requirements set forth by national, state, or local regulations can result in lost sales for manufacturers.

SUMMARY OF THE INVENTION

Accordingly, it is an object of the invention to provide a compact luminaire enclosure that dissipates heat effectively.

It is a further object of the invention to provide a compact luminaire enclosure with an internal thermal heat shield.

The invention generally comprises a compact luminaire enclosure that has about 14 to 18, and preferably 16, cubic inches of air volume and can be used safely with a 50 watt lamp. The luminaire enclosure comprises a housing and a shroud that is removably attached to the housing. The shroud has a non-planar face that prevents the shroud from laying flat and trapping heat if the enclosure is placed against or falls on a flat surface. The housing may be made of at least a portion of polyetherimide, which has very good heat dissipation properties. The shroud may similarly be made of at least a portion of polyetherimide.

The compact luminaire enclosure of the present invention further comprises an internal thermal lamp shield recessed within the housing. The internal thermal lamp shield comprises highly specular material so that it is able to reflect the heat coming from an enclosed lamp. In one embodiment of the invention, the internal thermal lamp shield comprises aluminum covered with glass that has been electrodeposited or sputtered onto its surface, although in another embodiment, the aluminum is anodized.

In one embodiment of the invention, the internal thermal lamp shield is part of a lamp holder assembly comprising a spring clip lamp holder, a lamp holder thermal shield, and a bi-pin lamp holder. In one embodiment of the invention, the lamp holder assembly further comprises two standoff screws that extend through two standoff screw tubes and connect the lamp holder assembly to the enclosure. The various parts of the lamp holder assembly and their arrangement facilitate heat dissipation effectively.

Generally, the structure and design of the compact luminaire enclosure described herein lowers the external enclosure surface temperature, which provides a significant improvement over prior art enclosures. The internal thermal lamp shield and the use of polyetherimide thermal plastic materials allow the enclosure to effectively lower inside and outside thermal plastic enclosure surface temperatures, which increases safety and decreases the likelihood of mechanical failure.

WRITTEN DESCRIPTION

While this invention is capable of embodiments in many different forms, the preferred embodiments are shown in the figures and will be herein described in detail.

The present disclosure is to be considered an exemplification of the principles of the invention and is not intended to limit the broad aspects of the invention to the embodiments illustrated.

Figure 1:
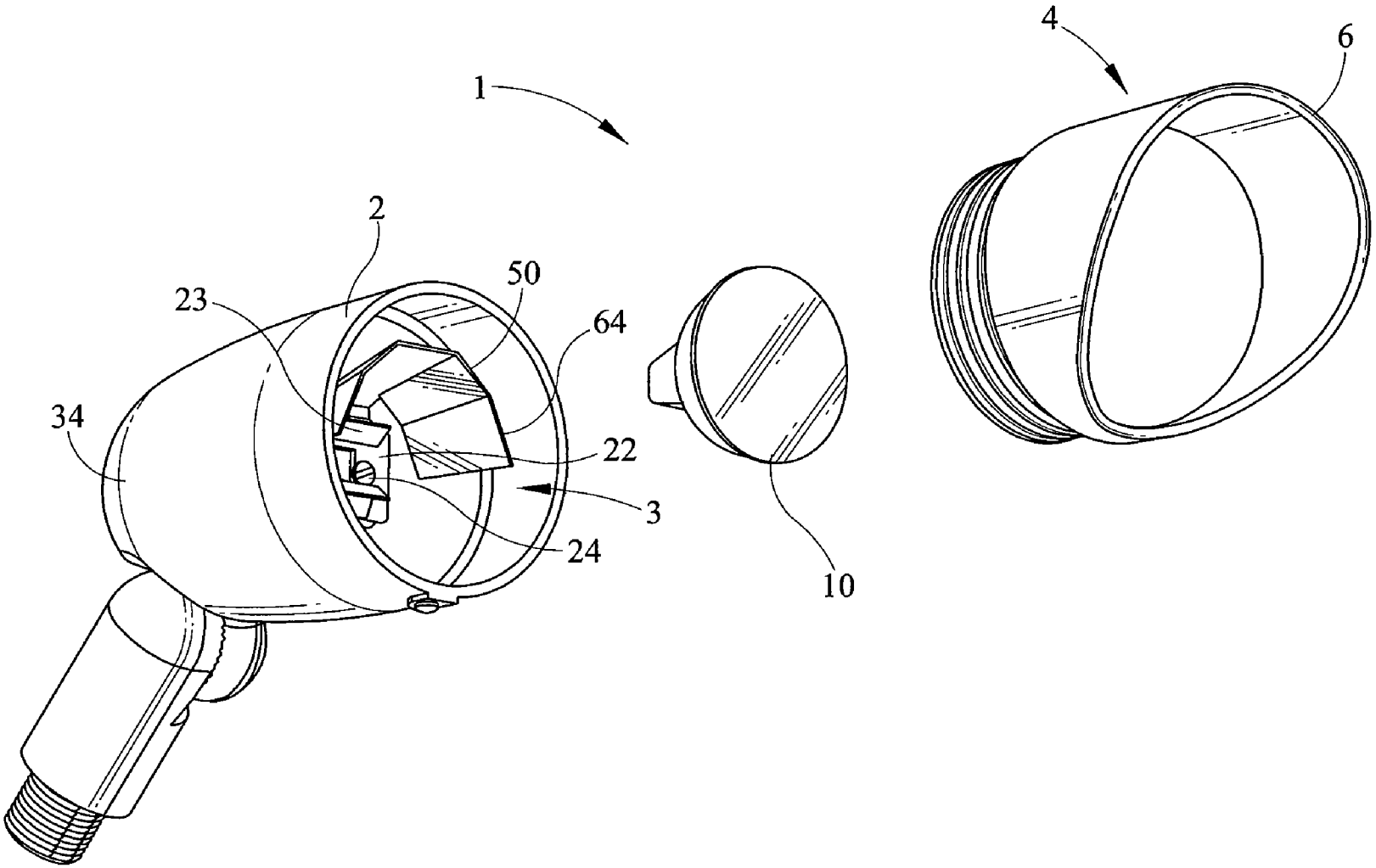
FIG. 1 is an exploded view of the enclosure with the luminaire, and shroud.

Referring now to the drawings, and specifically to FIG. 1, a compact luminaire enclosure 1 comprises a housing 2 and a shroud 4 that is removably attached to the housing 2. In one embodiment, the housing 2 measures between two and four inches in diameter, preferably three inches, at its opening 3 and tapers for a distance of between one and three inches, preferably two inches, to a diameter of between one and three inches, preferably 2 and ¼ inches, at its spherical closed back portion 34. In one embodiment, the shroud 4 is between one and three inches long. The dimensions of the housing provide between 14 and 18 inches of cubic air volume, and preferably 16 cubic inches of air volume, in order to mount enclosed components within it.

Figure 2:
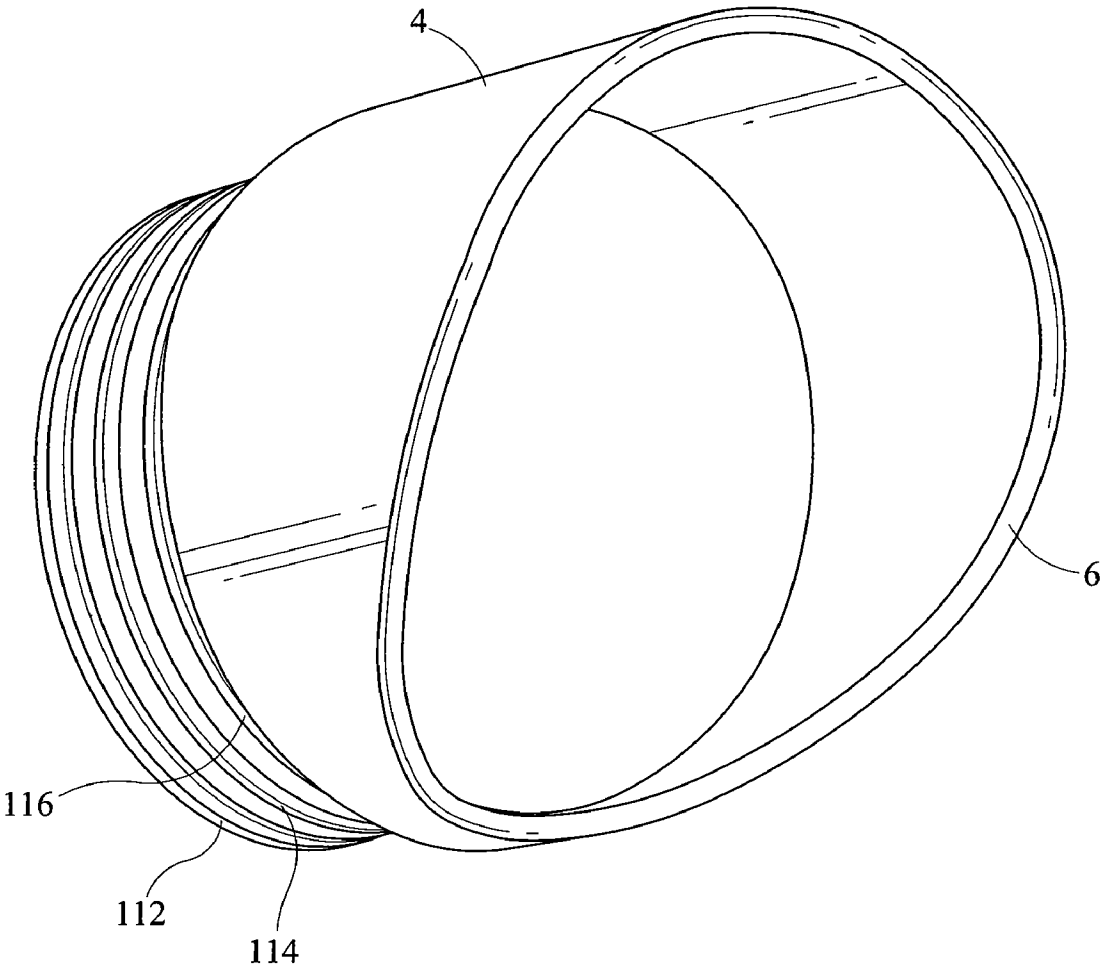
FIG. 2 is a perspective view of the shroud.

As shown in FIG. 2, the shroud 4 has a non-planar or non-flat face 6 that prevents the shroud 4 from trapping heat if the enclosure 1 is placed or falls on a flat surface, such as the ground. Enclosures in the prior art generally had flat, planar faces, which caused problems with overheating. If an enclosure has a flat face, it may lie flat on the ground and trap heat near the luminaire, thereby causing the luminaire to exceed its operating temperature.

Figure 3:
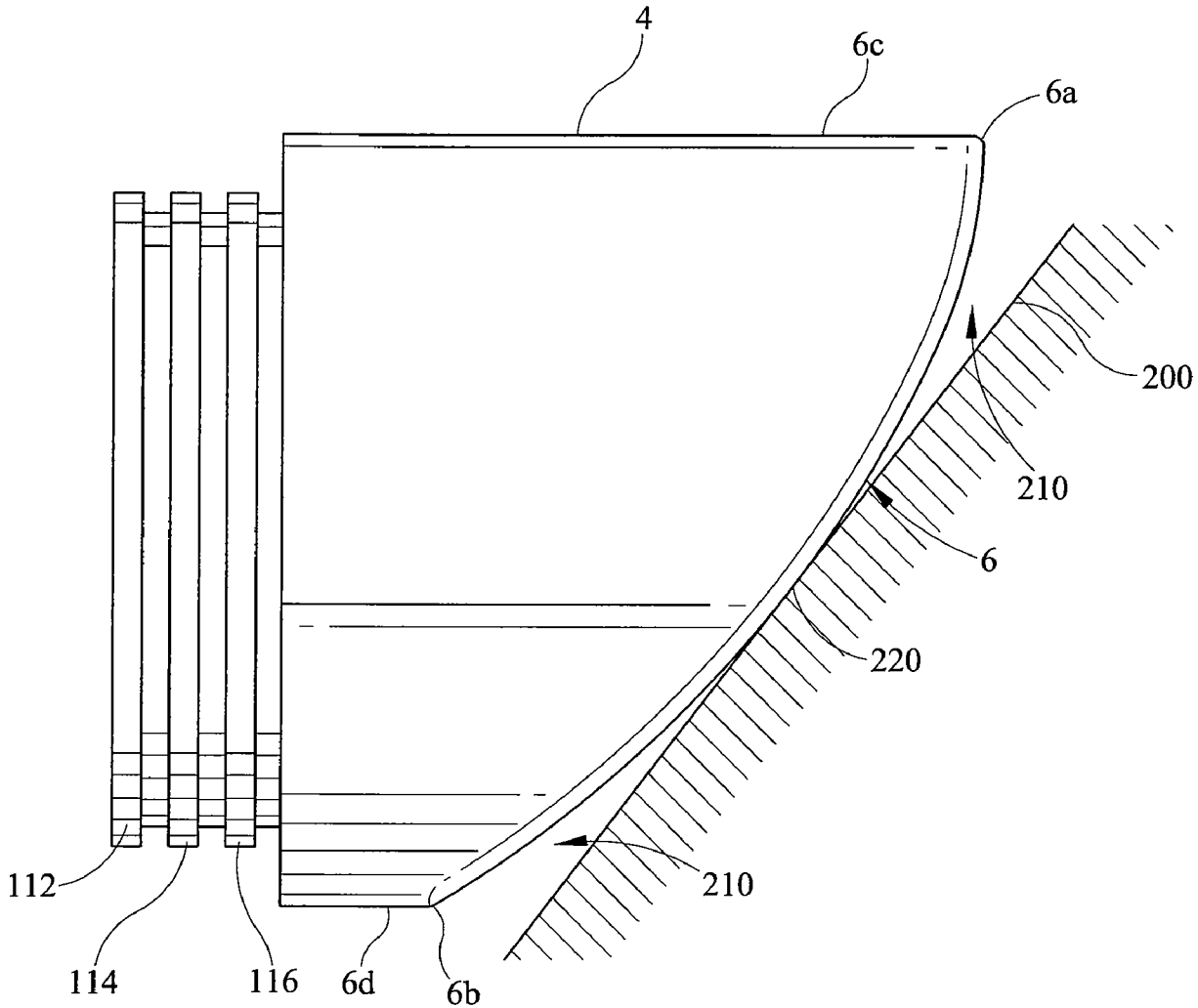
FIG. 3 is a side view of the shroud set against a flat surface.

The non-planar design of the shroud 4 of the invention helps to prevent the stoppage of airflow and excessive heat build up around the face of the enclosure 1 if it should ever be in this blocked position. As illustrated in FIG. 3, if the compact enclosure should fall on a flat surface 200, the edge 220 of the face 6 rests on the flat surface 200, but since the face 6 is non-planar, it is impossible for the shroud 4 to lay completely flat and trap heat. Instead, one or more venting spaces 210 comprising the open areas between the flat surface 200 and the non-planar face 6 exists when the edge 220 of the face 6 touches the flat surface 200. In the embodiment of the invention shown in FIG. 3, the non-planar face 6 is gently convexly curved from a first end 6*a* to a second end 6*b* and has a flat end 6*c* and flat lower end 6*d* extending rearward from each respective end. This gentle curve extending between the flat ends 6*c*, 6*d* provides an appealing appearance while also increasing the heat venting capability of the shroud 4. Many other non-planar designs would be suitable for the invention.

Figure 7:
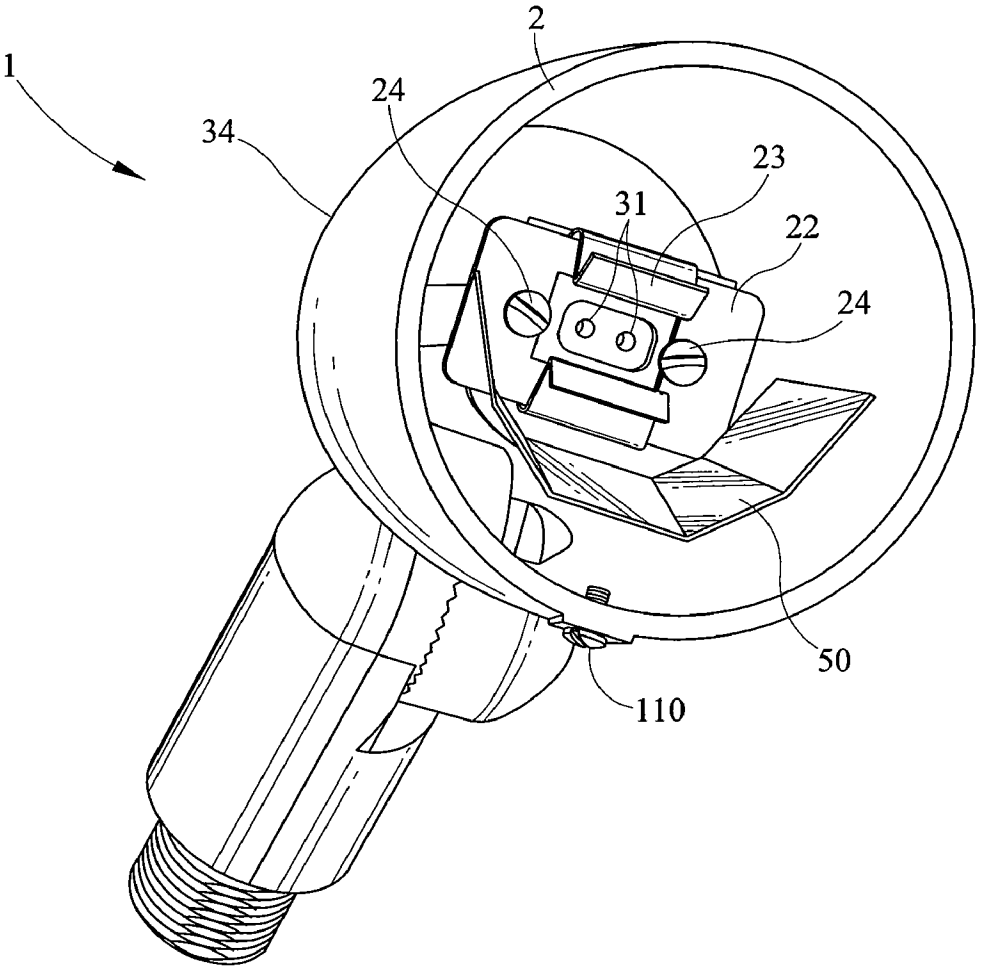
FIG. 7 is a front perspective view of the enclosure without the luminaire and shroud.

Referring again to FIG. 2, the shroud 4 inserts into the housing 2 and is held in place by a compression fit and a retaining screw 110, shown in FIG. 7. The shroud has two O-ring grooves 112, 114 and a retaining groove 116. O-rings fit into the two grooves 112, 114 closest to the housing, and the retaining screw 110 fits into the retaining groove 116 and holds the shroud 4 in place. The retaining groove 116 runs along the entire circumference of the shroud 4 so that the shroud 4 can be rotated easily by loosening the retaining screw 110, adjusting the shroud 4, and retightening the retaining screw 110 in the retaining groove 116.

The housing 2 preferably is made of polyetherimide—Ultem® produced by GE Plastics, for example—and the shroud 4 may be made of polyetherimide as well. When polyetherimide is used in the housing of a luminaire enclosure, especially a compact luminaire enclosure such as the enclosure 1 of the invention, the housing maintains its appearance and structure much better over time. Importantly, polyetherimide has a higher glass transition temperature than other materials, such as polyphenylene sulfide, that have previously been used in luminaire housings. Once a particular material reaches its glass transition temperature, its component molecules move around more freely, its chemical bonds begin to weaken, and the overall strength of the structure begins to decline.

Because luminaire enclosures are in close proximity to a heat source, they need to be made of materials that have high glass transition temperatures. In older enclosures, once the temperature of the housing exceeded the glass transition temperature, small pieces of fiberglass or other materials in the enclosure made their way to the surface and formed unattractive small bumps and discoloration on the housing. This effect also led to further degradation of the housing structure because it caused moisture to wick into the housing. With a polyetherimide housing, the enclosure is able to maintain its appearance and effectiveness for an extended period of time.

Referring once more to FIG. 1, in order to further prevent heat from an enclosed luminaire from excessively heating the housing, the compact luminaire enclosure 1 of the present invention comprises an internal thermal lamp shield 50 disposed within the housing 2 such that it reflects thermal energy from the lamp 10 away from the top portion of the enclosure 1.

Figure 4:
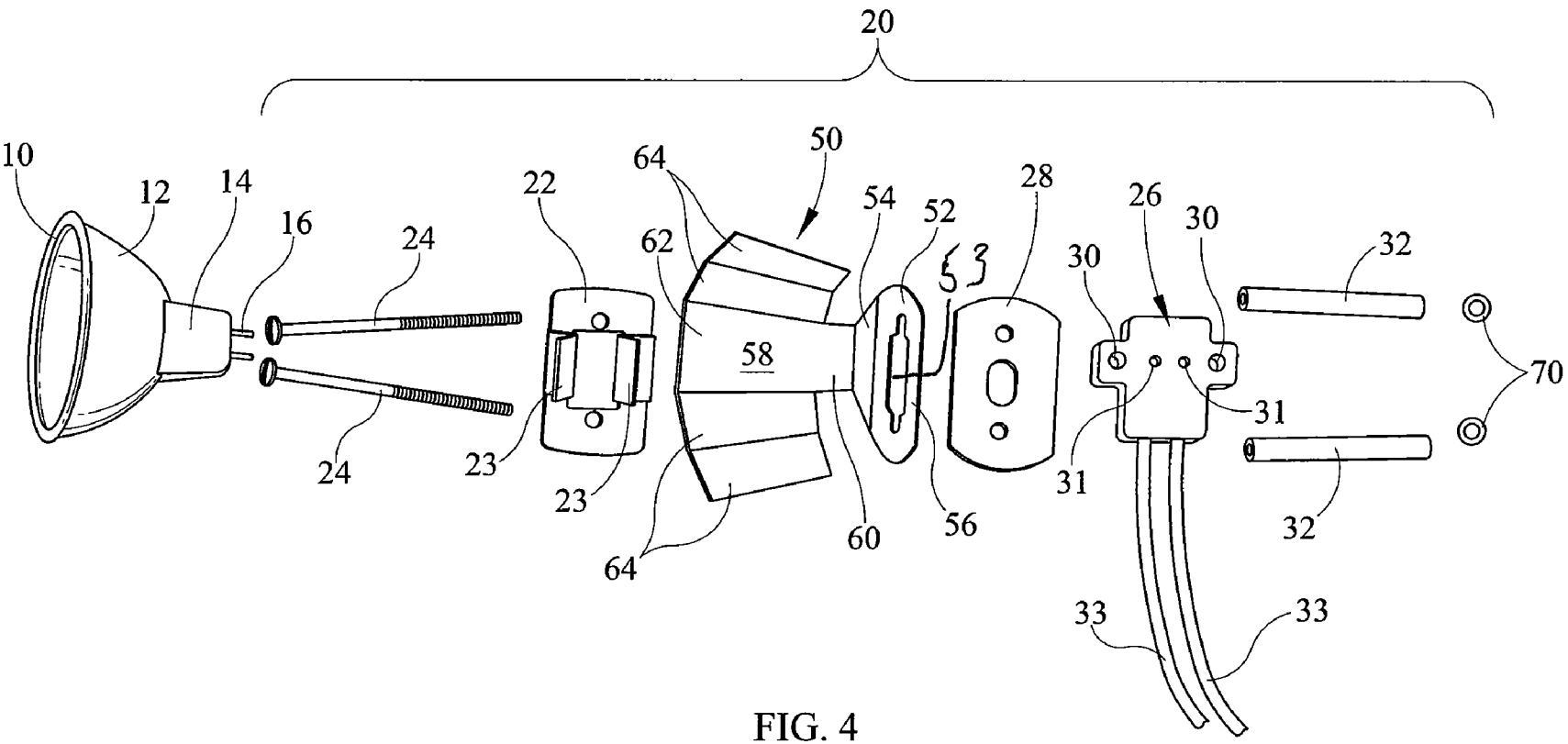
FIG. 4 is an exploded view of the luminaire and lamp holder assembly.
Figure 5:
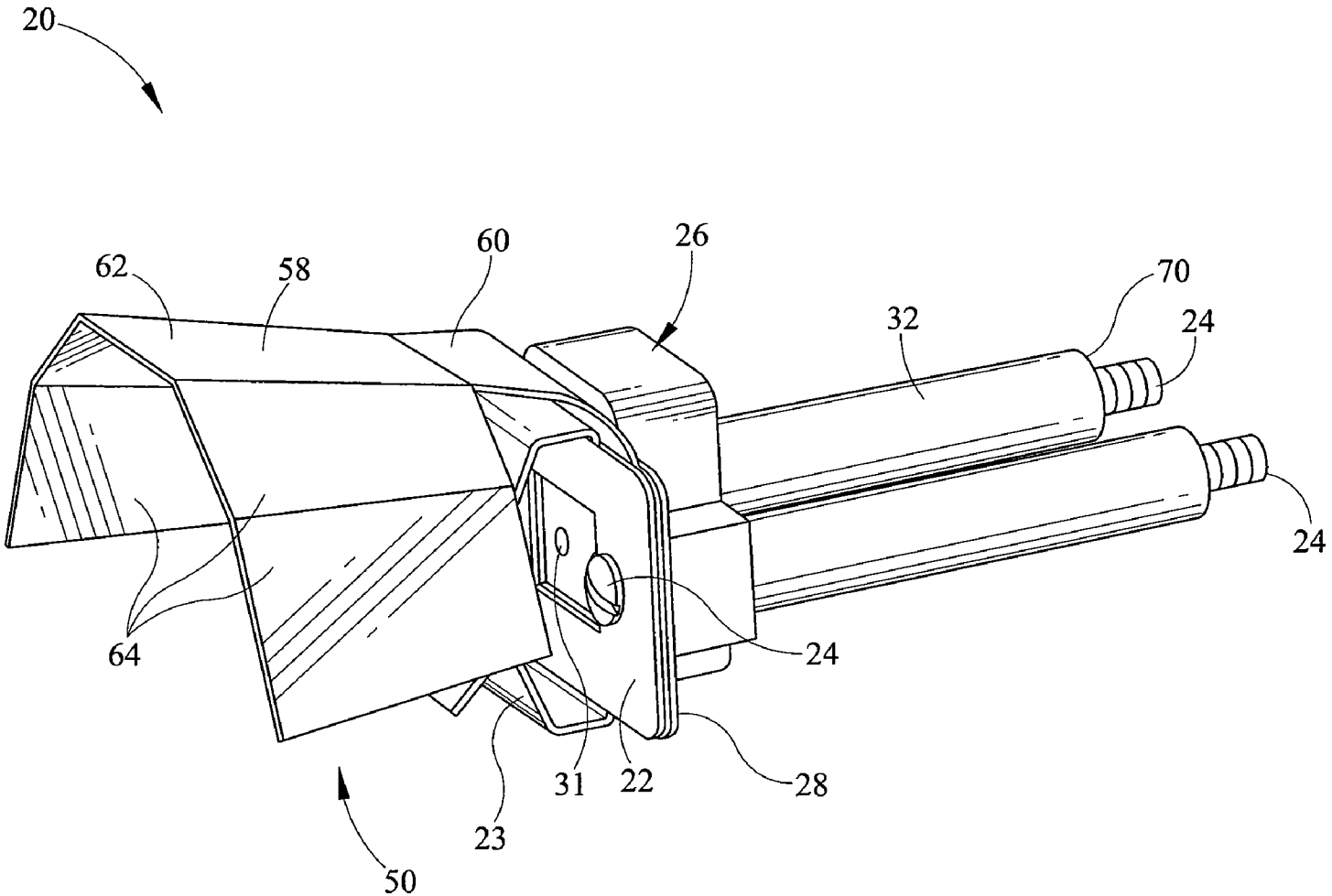
FIG. 5 is a perspective view of the internal thermal lamp shield and lamp holder assembly.

Referring now to FIGS. 4 and 5, in one embodiment of the invention, the internal thermal lamp shield 50 is part of a lamp holder assembly 20 that is specially designed in order to dissipate heat such that the enclosure 1 maintains a low temperature. The lamp holder assembly 20 has a spring clip lamp holder 22, two threaded standoff screws 24, a bi-pin lamp holder 26, and a lamp holder thermal shield 28. The spring clip lamp holder 22 has two spring clips 23 that project out from the holder 22. When the spring clips 23 are fastened to the lamp holder thermal shield 28, the clips 23 extend through the internal thermal lamp shield 50 and interconnect it with the shield 28 and the holder 22. The spring clips 23 attach to the lamp 10 and hold it in place. In FIG. 4, the lamp 10 supported by the lamp holder assembly 20 comprises a reflector portion 12 and a plug or back portion 14 having two pins 16. The plug portion 14 of the lamp 10 protrudes through the spring clip lamp holder 22, the internal thermal lamp shield 50, and the lamp holder thermal shield 28 so that they surround the plug or back portion 14. Bi-pin lamp holder 26 has electrical holes 31 and wires 33 that are used to connect the lamp 10 to an energy source (not shown). The pins 16 extend through electrical holes 31 of the bi-pin lamp holder 26 and make an electrical connection.

As can be seen more clearly in FIG. 5, the threaded standoff screws 24 do not attach to the lamp 10, but instead hold the lamp holder assembly 20 together by extending through the spring clip lamp holder 22, the internal thermal lamp shield 50, the lamp holder thermal shield 28, the bi-pin lamp holder 26, and insert into the two clinch pin standoff screw tubes 32. In the embodiment shown in FIG. 5, the screws 24 protrude beyond the standoff tubes 32, which allow the screws 24 to attach to the housing 2. The additional surface area of the standoff screw tubes 32 dissipates heat into the cooler back portion 34 (see FIG. 1) of the luminaire enclosure 1, thereby helping to lower the enclosure temperature near the lamp 10 and therefore preferably are constructed of a heat conducting material.

FIG. 4 shows two O-ring retainers 70 that are adaptable to slide over the screws 24 when the lamp holder assembly 20 is constructed. The O-ring retainers 70 hold the lamp holder assembly 20 together for easy installation, and they also break the direct thermal conduction between the standoff tubes 32 and the housing 2.

The order of the components of the lamp holder assembly 20 breaks the direct thermal conduction between the internal thermal lamp shield 50 and the bi-pin lamp holder 26. The lamp holder thermal shield 28 and the internal thermal lamp shield 50 minimize the conduction of thermal energy to the bi-pin lamp holder 26, thereby allowing the bi-pin lamp holder 26 to operate below its maximum suggested operating temperature while the lamp 10 is positioned in any mounting orientation. The ability to provide for limitless mounting orientation without over-heating the bi-pin lamp holder 26 greatly enhances the utility of the enclosure 1. Maintaining lower temperatures within the enclosure 1 helps prevent premature component failure and therefore increases luminaire life and reliability. The heat-dissipating design of the compact luminaire enclosure allows it to be used with lamps that produce a great deal of heat, such as a 50 watt MR-16 type lamp.

In one embodiment, the spring clip lamp holder 22 is made of stainless steel. The use of a stainless steel spring clip as the lamp holder 22 helps prevent clip corrosion and loss of spring tension, and it also provides a positive vibration-proof lamp grip in any luminaire mounting orientation without lamp breakage. The spring clip lamp holder 22 of the invention has two functions: it acts as a heat sink and it also maintains the position of the luminaire 10.

Figure 6:
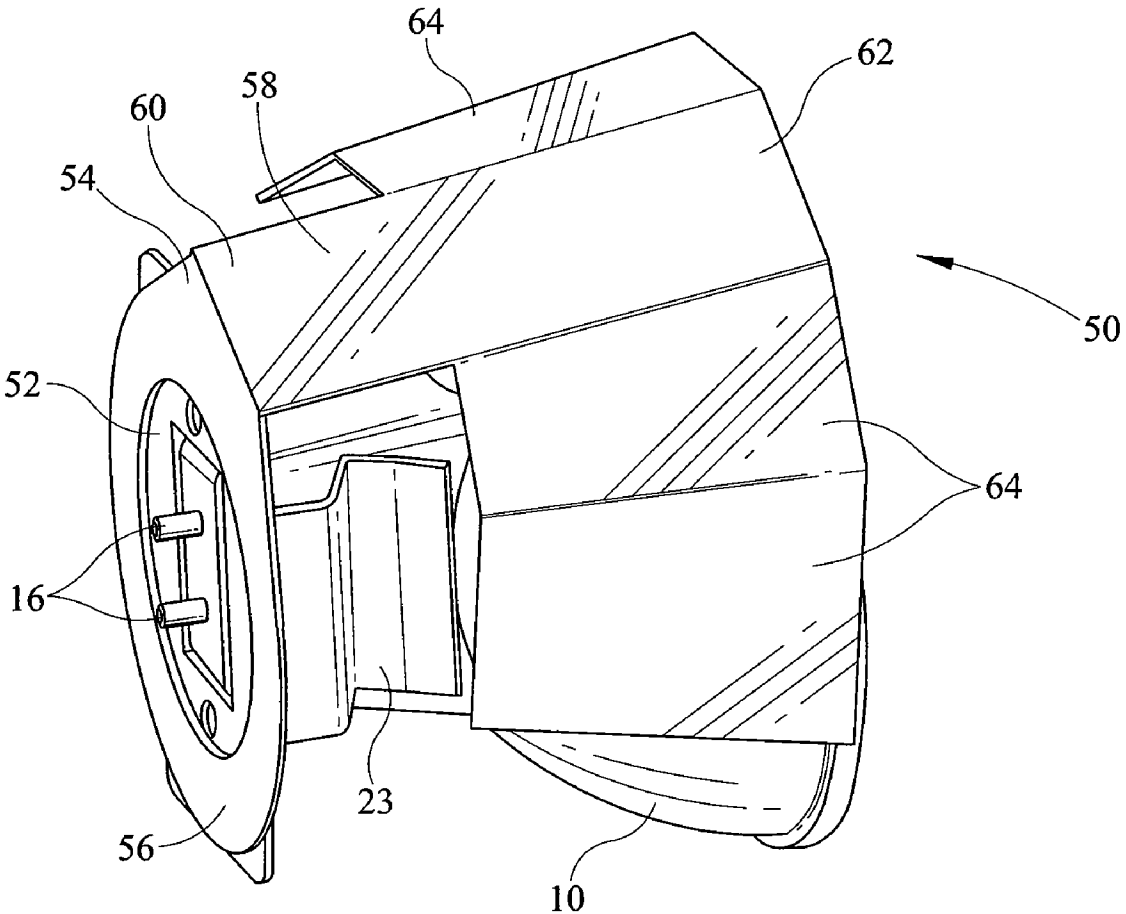
FIG. 6 is a perspective view of the luminaire, the lamp holder assembly, and the internal thermal lamp shield.

Returning now to a discussion of the internal thermal lamp shield 50, as shown in the embodiments of FIGS. 4, 5, and 6, the internal thermal lamp shield 50 comprises an oval-shaped base ring 52 having a central aperture 53 that has a top end 54 and a bottom end 56. Extending from the peaked top end 54 of the oval-shaped base portion 52 is a rectangular linker portion or support arm 58 comprising a first end 60 and a second end 62. The first end 60 of the support arm 58 extends from the peaked top end 54 of the oval-shaped base portion 52 into an arcuate shield 64 surrounding at least a portion of the lamp 10. In one embodiment, the shield 64 comprises one or more protective faces 64 that fan out from the support arm 58 and extend over the lamp 10 to redirect thermal energy that would otherwise heat up the surface of the housing 2. The O-shaped base portion 52 is situated within the lamp holder assembly 20 so that the internal thermal lamp shield 50 extends above and past the lamp 10. In this embodiment of the invention, the faces 64 of the internal thermal lamp shield 50 fan out and partially surround the lamp 10 in order to block and redirect heat that would otherwise hit the housing 2 of the enclosure 1.

The internal thermal heat shield 50 preferably comprises specular finished materials that enable the shield to direct thermal energy away from the enclosure 1. These specular materials include, for example, aluminum coated with glass that has been sputtered or electrodeposited on its surface.

Figure 8:
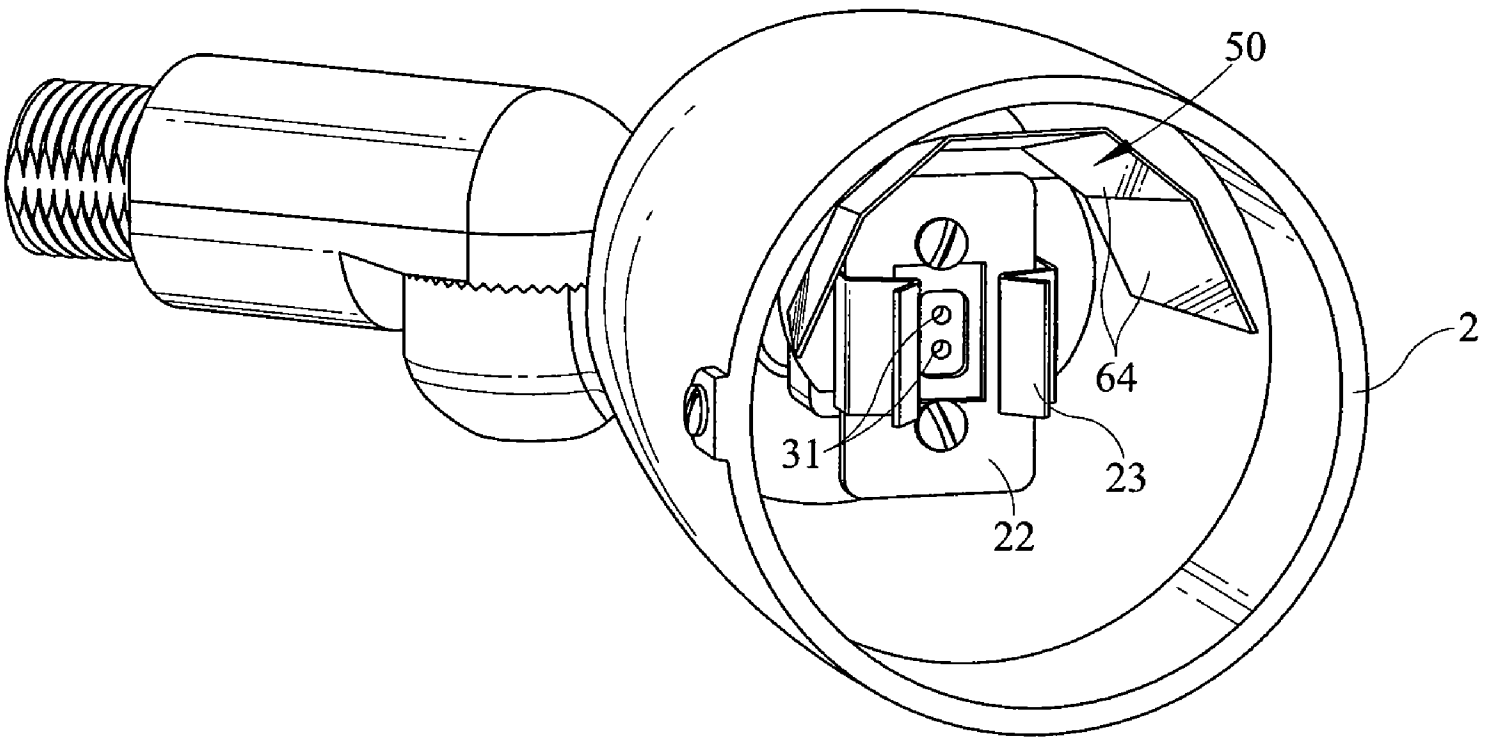
FIG. 8 is a front perspective view of the enclosure with the internal thermal lamp shield in a rotated position.

The internal thermal lamp shield 50 is also preferably rotatable about the lamp holder assembly 20. FIG. 7 shows the compact luminaire enclosure 1 of the invention with the internal thermal lamp shield 50 in one orientation. In contrast, FIG. 8 shows the internal thermal lamp shield 50 in a different orientation than that shown in FIG. 7, which demonstrates the rotatability of the shield 50. This rotatability allows the internal thermal lamp shield 50 to be maintained in virtually any position around a luminaire while it is in use. In order to adjust the internal thermal lamp shield 50, the standoff screws 24 can be loosened so that the thermal shield 50 can be rotated and fixed in another position even while the lamp 10 is still attached to the rest of the lamp holder assembly 20. The pins 16 of the lamp 10 attach to the bi-pin lamp holder 26 and protrude through the circular aperture 53 in the middle of the internal thermal lamp shield 50 without being directly attached to the lamp shield 50, which leaves the lamp shield 50 free to rotate around the pins 16 once the standoff screws 24 are loosened.

While there have been described what are believed to be the preferred embodiments of the present invention, those skilled in the art will recognize that other and further changes and modifications may be made thereto without departing from the spirit of the invention, and it is intended to claim all such changes and modifications as fall within the true scope of the invention.

We claim:

1. A compact luminaire enclosure comprising:
- a lamp contained within a housing;
- an internal thermal lamp shield recessed within said housing and in close proximity to said lamp;
- a lamp holder thermal shield mounted to a pin lamp holder and between said lamp and said pin lamp holder; and
- a spring clip mounted against said pin lamp holder, said spring clip having at least one clip engaging said lamp and capable of extending within an area defined by said internal thermal lamp shield, said spring clip attached to said lamp holder thermal shield.

2. The compact luminaire enclosure of claim 1 further comprising a shroud being removably attached to an outer annular rim of said housing.

3. The compact luminaire enclosure of claim 2, wherein the shroud has a non-planar face, thereby creating a venting area for said enclosure.

4. The compact luminaire enclosure of claim 3 further comprising an outside edge, wherein the edge of said shroud is convexly curved and non-planar.

5. The compact luminaire enclosure of claim 1, wherein said internal thermal lamp shield comprises:
- a circular aperture base ring;
- a support arm below the ring and the shield; and
- an arcuate shield surrounding at least a portion of said lamp.

6. The compact luminaire enclosure of claim 1, wherein said internal thermal lamp shield is arcuate and partially surrounds said lamp and has a rotatable base.

7. The compact luminaire enclosure of claim 1, wherein said enclosure is made of polyetherimide.

8. The compact luminaire enclosure of claim 1 further comprising:
- a bi-pin lamp holder;
- at least one standoff screw; and
- at least one standoff screw tube;
- wherein said at least one standoff screw extends through said internal thermal lamp shield, said lamp holder thermal shield, and said bi-pin lamp holder;
- wherein said at least one standoff screw inserts into said at least one standoff screw tube.

9. The compact luminaire enclosure of claim 1, said internal thermal lamp shield comprising:
- a substantially O-shaped base portion having a top end and a bottom end;
- a rectangular portion comprising a first end and a second end, wherein said first end of said rectangular portion extends from said top end of said substantially O-shaped portion; and
- one or more protective faces fanning out from said second end of said rectangular portion.

10. A lamp holder assembly for a compact luminaire enclosure, said lamp holder assembly comprising:
- an internal thermal lamp shield recessed within a housing and in close proximity to a lamp;
- a lamp holder thermal shield mounted to a lamp holder between said lamp holder thermal shield and said lamp holder adjacent to said internal thermal lamp shield; and
- a spring clip lamp holder mounted to said lamp holder and having at least one clip capable of extending through a shielded area said internal thermal lamp shield for attachment to said lamp holder thermal shield.

11. The lamp holder assembly of claim 10 further comprising a bi-pin lamp holder being attachable to a lamp.

12. The lamp holder assembly of claim 11, said lamp holder assembly further comprising:
- at least one standoff screw; and
- at least one standoff screw tube;
- wherein said at least one standoff screw extends through said internal thermal lamp shield, said lamp holder thermal shield, and said bi-pin lamp holder,
- wherein said at least one standoff screw inserts into said at least one standoff screw tube.

13. The lamp holder assembly of claim 12, wherein said lamp holder assembly has at least one O-ring retainer, wherein said at least one O-ring retainer is adaptable to attach to said at least one standoff tube.

14. An internal thermal lamp shield capable of being housed within a luminaire enclosure comprising:

a bi-pin lamp holder receiving a lamp, said lamp at least partially surrounded by a thermal lamp shield affixed to a lamp holder;

a housing securing said lamp holder near a rear wall, said lamp shield positioned between said lamp and a wall of said housing;

said housing having an outwardly facing shroud removably connected to an outer annular rim of said housing said shroud having a curved face extending between flat ends of said shroud to create at least one venting space.

15. The internal thermal lamp shield of claim 14, said lamp shield comprising:

a substantially O-shaped base portion having a top end and a bottom end;

a rectangular portion comprising a first end and a second end, wherein said first end of said rectangular portion extends from said top end of said substantially O-shaped portion; and one or more protective faces fanning out from said second end of said rectangular portion.

16. The internal thermal lamp shield of claim 14, said lamp shield comprising:

a circular aperture base ring;

a support arm below the ring and the shield; and an arcuate shield surrounding at least a portion of said lamp, wherein said internal thermal lamp shield is rotatable.

17. The internal thermal lamp shield of claim 16, wherein said lamp shield is positioned in sequence with a spring clip lamp holder preceding said lamp shield and lamp holder thermal shield following said lamp shield, a bi-pin lamp holder and a back portion of the enclosure following said lamp shield.

18. A compact luminaire enclosure comprising:

a lamp contained within a housing;

an internal thermal lamp shield recessed within said housing and in close proximity to said lamp;

a lamp holder thermal shield mounted between said lamp and a bi-pin lamp holder;

a spring clip lamp holder mounted against said lamp holder thermal shield, said spring clip having at least one clip engaging said lamp;

said internal lamp thermal shield mounted between said spring clip and said lamp holder thermal shield.

19. A lamp holder assembly for a compact luminaire enclosure, said lamp holder assembly comprising:

an internal thermal lamp shield recessed within a housing and in close proximity to a lamp;

a lamp holder thermal shield mounted to a bi-pin lamp holder, said lamp holder thermal shield disposed between said lamp holder thermal shield and said bi-pin lamp holder, said bi-pin lamp holder being disposed adjacent to said internal thermal lamp shield, said bi-pin lamp holder being attachable to a lamp; and a spring clip lamp holder mounted to said bi-pin lamp holder and having at least one clip capable of extending within an area defined by said internal thermal lamp shield for attachment to said lamp holder thermal shield.

20. The lamp holder assembly of claim 19, said lamp holder assembly further comprising:

at least one standoff screw; and at least one standoff screw tube;

wherein said at least one standoff screw extends through said internal thermal lamp shield, said lamp holder thermal shield, and said bi-pin lamp holder, wherein said at least one standoff screw inserts into said at least one standoff screw tube.

21. The lamp holder assembly of claim 20, wherein said lamp holder assembly has at least one O-ring retainer, wherein said at least one O-ring retainer is adaptable to attach to said at least one standoff tube.

* * * * *